US011488514B2

(12) United States Patent
Zhao

(10) Patent No.: US 11,488,514 B2
(45) Date of Patent: Nov. 1, 2022

(54) DISPLAY PANEL AND DISPLAY APPARATUS

(71) Applicants: HKC CORPORATION LIMITED, Shenzhen (CN); CHONGQING HKC OPTOELECTRONICS TECHNOLOGY CO., LTD., Chongqing (CN)

(72) Inventor: Wenqin Zhao, Chongqing (CN)

(73) Assignees: HKC CORPORATION LIMITED, Shenzhen (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 0 days.

(21) Appl. No.: 17/042,180

(22) PCT Filed: Dec. 20, 2018

(86) PCT No.: PCT/CN2018/122224
§ 371 (c)(1),
(2) Date: Sep. 27, 2020

(87) PCT Pub. No.: WO2020/118748
PCT Pub. Date: Jun. 18, 2020

(65) Prior Publication Data

US 2021/0118355 A1 Apr. 22, 2021

(30) Foreign Application Priority Data

Dec. 13, 2018 (CN) ..... 201811522216.9

(51) Int. Cl.
*G09G 3/20* (2006.01)
*G09G 3/36* (2006.01)
*G09G 5/18* (2006.01)

(52) U.S. Cl.
CPC ..... *G09G 3/2092* (2013.01); *G09G 3/3611* (2013.01); *G09G 3/3688* (2013.01);
(Continued)

(58) Field of Classification Search
CPC .. G09G 3/3648; G09G 3/3611; G09G 3/3688; G09G 3/2092; G09G 2310/08;
(Continued)

(56) References Cited

U.S. PATENT DOCUMENTS 9,812,084 B2 * 11/2017 Kim ..... G09G 3/2092
9,934,715 B2 * 4/2018 Lee ..... G09G 3/20
(Continued)

FOREIGN PATENT DOCUMENTS

CN 102239516 A 11/2011
CN 104809999 A 7/2015
(Continued)

OTHER PUBLICATIONS

Jie Zhong, the ISA written comments, Sep. 2019, CN.
Jie Zhong, the International Search Report, dated Sep. 2019, CN.

*Primary Examiner* — Dismery Mercedes

(57) ABSTRACT

The present application discloses a display apparatus and a drive method thereof. The display apparatus includes a display panel, and a panel chive circuit configured to drive the display panel; and a timing controller respectively transmits a signal to source drivers and a gate driver via the bus.

10 Claims, 4 Drawing Sheets

(52) U.S. Cl.
CPC ..... *G09G 5/18* (2013.01); *G09G 2310/0267* (2013.01); *G09G 2310/0275* (2013.01); *G09G 2310/08* (2013.01); *G09G 2370/08* (2013.01)

(58) Field of Classification Search
CPC ... G09G 2310/0278; G09G 2310/0267; G09G 2310/0275; G09G 5/18; G09G 2354/00; G09G 2370/04; G09G 2370/045; G09G 2370/14; G09G 2370/08; G06F 3/0416; G06F 3/0412; G06F 2212/455
See application file for complete search history.

(56) References Cited

U.S. PATENT DOCUMENTS 10,089,918 B2 * 10/2018 Kwon ..... G09G 3/2096
10,380,971 B2 * 8/2019 Oh ..... G09G 5/006
10,931,047 B2 * 2/2021 Lee ..... H01R 12/78
2005/0168420 A1 * 8/2005 Chung ..... G09G 5/006 345/87
2008/0211791 A1 * 9/2008 Ryu ..... H04L 25/0272 345/204
2008/0246755 A1 * 10/2008 Lee ..... G09G 3/20 345/214
2009/0274241 A1 * 11/2009 Tsao ..... G09G 3/3611 375/295
2011/0292089 A1 * 12/2011 Nakahata ..... G09G 3/3406 345/102
2015/0356925 A1 12/2015 Lee et al.
2016/0027398 A1 * 1/2016 Kim ..... H05K 3/361 345/212
2017/0069257 A1 * 3/2017 Lee ..... G09G 5/005
2017/0193954 A1 * 7/2017 Wu ..... G09G 3/3677
2019/0385547 A1 * 12/2019 Chen ..... G09G 3/2092

FOREIGN PATENT DOCUMENTS

CN 105185325 A 12/2015
CN 106847163 A 6/2017
JP 2011197353 A 10/2011

* cited by examiner

DISPLAY PANEL AND DISPLAY APPARATUS

CROSS REFERENCE OF RELATED APPLICATIONS

The present application claims priority to the Chinese Patent Application No. CN201811522216.9, filed to the Chinese Patent Office on Dec. 13, 2018 and entitled "DISPLAY PANEL AND DISPLAY APPARATUS", which is incorporated herein by reference in its entirety.

TECHNICAL FIELD

The present application relates to the technical field of display, and in particular to a display panel and a display apparatus.

BACKGROUND

It should be understood that the statements in this section merely provide background information related to the present application and may not constitute prior art.

Along with the development and progress of science and technology, a flat-panel display has become a mainstream display product and is widely applied because of hot points such as a thin body, power saving and low radiation. Flat-panel displays include a Thin Film Transistor-Liquid Crystal Display (TFT-LCD) and an Organic Light-Emitting Diode (OLED) display, etc. Among them, the TFT-LCD refracts light rays of a backlight module by controlling rotation direction of liquid crystal molecules to generate a picture and thus has numerous advantages such as a thin body, power saving and no radiation. The OLED display is made of an OLED and has many advantages such as self-illumination, short response time, high definition and contrast ratio, and capability of implementing flexible display and large-area full-color display.

However, various materials used in a display panel are increased and various needed technologies are increased, resulting in a problem of high cost of the display panel.

SUMMARY

An object of the present application is to provide a display panel and a display apparatus to reduce the cost of the display apparatus.

To this end, the present application provides a display apparatus, which includes a display panel, and a panel drive circuit configured to drive the display panel to display; the panel drive circuit includes source drivers configured to drive a data line of the display panel, a gate driver configured to drive a scanning line of the display panel, a timing controller configured to control the source drivers and the gate driver by driving, and a bus; the timing controller is respectively connected to the source drivers and the gate driver via the bus; and the timing controller respectively transmits a signal to the source drivers and the gate driver via the bus.

Optionally, a plurality of source drivers are provided; the bus includes:

data transmission lines, where the timing controller respectively transmits a data signal to the gate driver and the source drivers via the data transmission lines; and a plurality of source driver selection signal lines, where the timing controller is connected with the source drivers via the source driver selection signal lines; the source driver selection signal lines are connected with the source drivers in one-to-one correspondence; and the source drivers read the data signals from the data transmission lines upon the reception of source driver selection signals of corresponding source driver selection signal lines.

Optionally, two data transmission lines are provided.

Optionally, the panel drive circuit further includes a control circuit board and a flexible circuit board; the timing controller is located on the control circuit board; the source drivers and the gate driver are located on the flexible circuit board; a portion, connected with the timing controller, of the bus is on the control circuit board; and branched points generated by that the bus is respectively connected with the source drivers and the gate driver are on the flexible circuit board.

Optionally, the panel drive circuit further includes a memory configured to store data; and the memory is connected with the timing controller.

The present application further discloses a display apparatus, which includes a display panel, and a panel drive circuit configured to drive the display panel to display;

the panel drive circuit includes: a control circuit board, a flexible circuit board, source drivers, a gate driver, a timing controller, a memory and a bus;

the source drivers are configured to drive a data line of the display panel, and are located on the flexible circuit board;

the gate driver is configured to drive a scanning line of the display panel, and is located on the flexible circuit board;

the timing controller is configured to control the source drivers and the gate driver by driving, and is located on the control circuit board;

the memory is configured to store data, and is connected with the timing controller; and the timing controller reads data signals and source driver selection signals from the memory on the control circuit board;

a portion, connected with the timing controller, of the bus is on the control circuit board; branched points generated by that the bus is respectively connected with the source drivers and the gate driver are on the flexible circuit board;

the bus includes:

data transmission lines, where the timing controller respectively transmits the data signals to the gate driver and the source drivers via the data transmission lines; and source driver selection signal lines, where the timing controller is connected with the source drivers via the source driver selection signal lines; the source driver selection signal lines are connected with the source drivers in one-to-one correspondence; and the source drivers read the data signals from the data transmission lines upon the reception of the source driver selection signals of corresponding source driver selection signal lines.

The present application further discloses a drive method of a display apparatus, where the display apparatus includes:

a display panel; and a panel drive circuit, configured to drive the display panel;

the panel drive circuit includes:

source drivers, configured to drive a data line of the display panel;

a gate driver, configured to drive a scanning line of the display panel;

a timing controller, configured to control the source drivers and the gate driver by driving; and a bus, configured to transmit signals;

the timing controller is respectively connected with the source drivers and the gate driver via the bus; and the timing controller respectively transmits the signals to the source drivers and the gate driver via the bus; and the drive method includes:

a signal transmission step: transmitting, by the timing controller, data signals to the bus; and a signal receiving step: receiving, by the source drivers and the gate driver, the data signals from the bus.

Optionally, a plurality of the source drivers are provided;

the bus includes:

data transmission lines, where the timing controller respectively transmits the data signals to the gate driver and the source drivers via the data transmission lines; and a plurality of source driver selection signal lines, where the timing controller is connected with the source drivers via the source driver selection signal lines; the source driver selection signal lines are connected with the source drivers in one-to-one correspondence; and the source drivers read the data signals from the data transmission lines upon the reception of source driver selection signals of corresponding source driver selection signal lines.

Optionally, two data transmission lines are provided.

Optionally, the panel drive circuit further includes a control circuit board and a flexible circuit board; the timing controller is located on the control circuit board; the source drivers and the gate driver are located on the flexible circuit board; a portion, connected with the timing controller, of the bus is on the control circuit board; and branched points generated by that the bus is respectively connected with the source drivers and the gate driver are on the flexible circuit board.

Optionally, the panel drive circuit further includes a memory configured to store data; and the memory is connected with the timing controller.

Optionally, the bus includes the data transmission lines and the source driver selection signal lines;

the signal transmission step includes: transmitting, by the timing controller, the data signals to the data transmission lines, and transmitting the source driver selection signals to the source driver selection signal lines; and the signal receiving step includes: receiving, by the source drivers and the gate driver, the data signals from the data transmission lines according to the source driver selection signals.

Optionally, the timing controller reads the data signals and the source driver selection signals from the memory in the signal transmission step.

Optionally, the data signals include a first data signal and a second data signal;

the signal transmission step includes: sending, by the timing controller, the first data signal to the source drivers for decoding to generate the second data signal; and transmitting, by the source drivers, the second data signal to the bus; and the signal receiving step includes: receiving, by the gate driver, the second data signal from the bus.

Optionally, the first data signal includes a source drive signal and a gate drive signal; and the source drivers decode the gate drive signal and send the decoded gate drive signal to the bus.

Compared with a solution in which many connection lines are used so that each source driver has a large number of pins, through a manner in which the source drivers and the gate driver share the bus to receive the signals sent out by the timing controller and the shared bus performs signal transmission, pins of a source driver are saved and thus the encapsulation cost is reduced; and meanwhile, a space is saved for a layout of a Printed Circuit Board (PCB) and a convenience is provided.

BRIEF DESCRIPTION OF DRAWINGS

The drawings are included to provide further understanding of embodiments of the present application, which constitute a part of the specification and illustrate the embodiments of the present application, and describe the principles of the present application together with the text description. Apparently, the accompanying drawings in the following description show merely some embodiments of the present application, and a person of ordinary skill in the art may still derive other accompanying drawings from these accompanying drawings without creative efforts. In the accompanying drawings.

DETAILED DESCRIPTION

Figure 1:
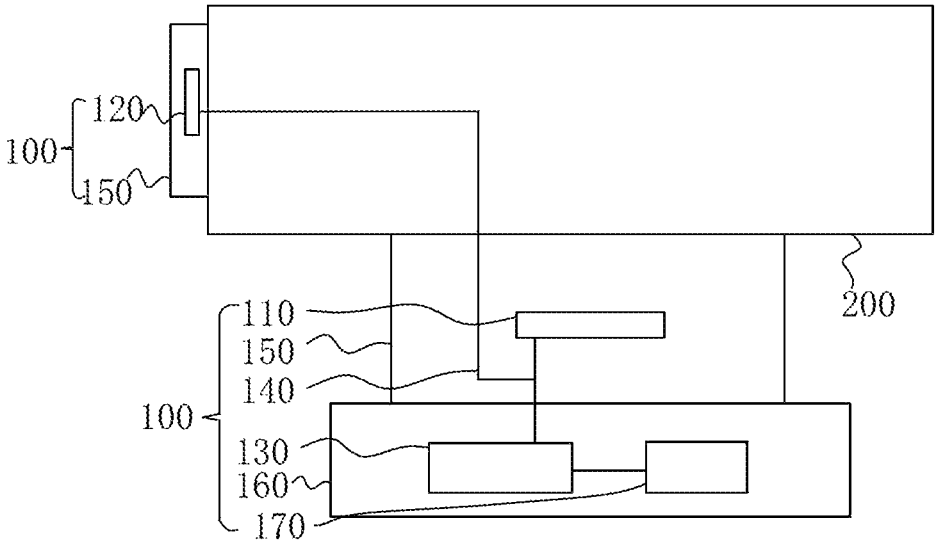
FIG. 1 is a schematic diagram of a display apparatus in an embodiment of the present application.

The specific structure and function details disclosed herein are merely representative; and are intended to describe exemplary embodiments of the present application. However, the present application can be specifically embodied in many alternative forms, and should not be interpreted to be limited to the embodiments described herein.

In the description of the present application, it should be understood that, orientation or position relationships indicated by the terms "center", "transversal", "upper", "lower", "left", "right", "vertical", "horizontal", "top", "bottom", "inner", "outer", etc. are based on the orientation or position relationships as shown in the drawings, for ease of the description of the present application and simplifying the description only, rather than indicating or implying that the indicated device or element must have a particular orientation or be constructed and operated in a particular orientation. Therefore, these terms should not be understood as a limitation to the present application. In addition, the terms such as "first" and "second" are merely for a descriptive purpose, and cannot be understood as indicating or implying a relative importance, or implicitly indicating the number of the indicated technical features, Hence, the features defined by "first" and "second" can explicitly or implicitly include one or more features. In the description of the present application, "a plurality of" means two or more, unless otherwise stated. In addition, the term "include" and any variations thereof are intended to cover a non-exclusive inclusion.

In the description of the present application, it should be understood that, unless otherwise specified and defined, the terms "install", "connected with", "connected to" should be comprehended in a broad sense. For example, these terms may be comprehended as being fixedly connected, detachably connected or integrally connected; mechanically connected or coupled; or directly connected or indirectly connected through an intermediate medium, or in an internal communication between two elements. The specific meanings about the foregoing terms in the present application may be understood by those skilled in the art according to specific circumstances.

The terms used herein are merely for the purpose of describing the specific embodiments, and are not intended to limit the exemplary embodiments. As used herein, the singular forms "a", "an" are intended to include the plural forms as well, unless otherwise indicated in the context clearly. It will be further understood that the terms "comprise" and/or "include" used herein specify the presence of the stated features, integers, steps, operations, elements and/or components, but do not preclude the presence or addition of one or more other features, integers, steps, operations, elements, components and/or combinations thereof.

The present application will be further described below in combination with the accompanying drawings and optional embodiments.

Figure 2:
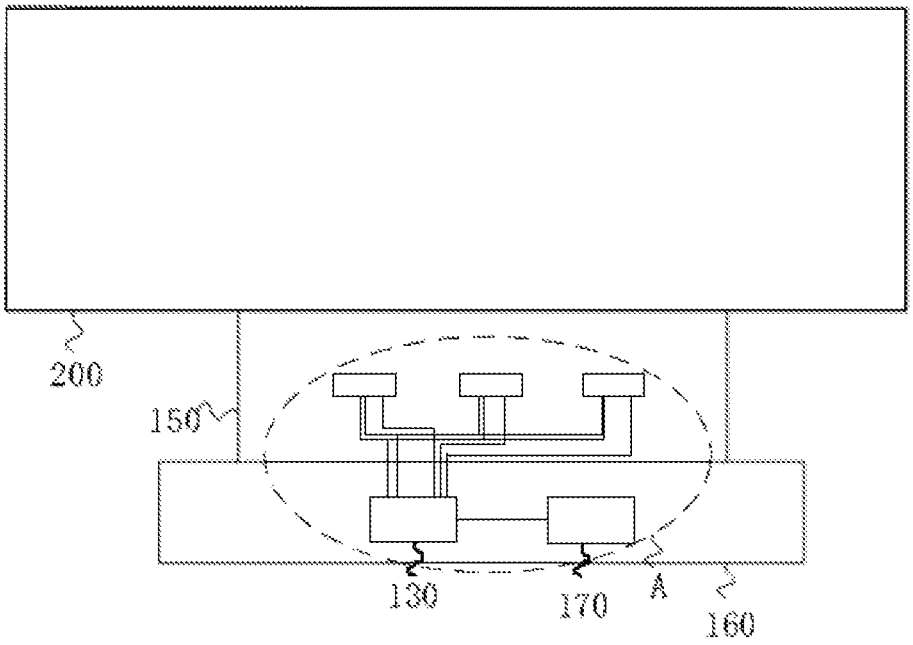
FIG. 2 is a schematic diagram of a display apparatus in an embodiment of the present application.
Figure 3:
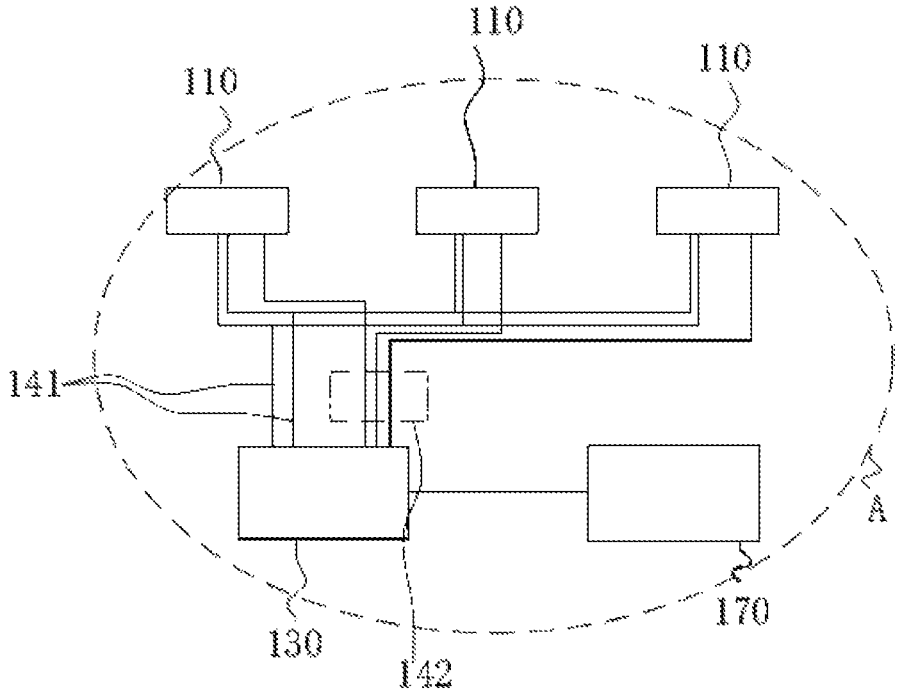
FIG. 3 is a schematic diagram of a local A in an embodiment of the present application.

Referring to FIG. 1 to FIG. 3, an embodiment of the present application discloses a display apparatus, which includes: a display panel 200, and a panel drive circuit 100 configured to drive the display panel 200 to display; the panel drive circuit 100 includes: source drivers 110 configured to drive a data line of the display panel 200, a gate driver 120 configured to drive a scanning line of the display panel 200, a timing controller 130 configured to control the source drivers 110 and the gate driver 120 by driving, and a bus 140; the timing controller 130 is respectively connected to the source drivers 110 and the gate driver 120 via the bus 140; and the timing controller 130 respectively transmits a signal to the source drivers 110 and the gate driver 120 via the bus 140.

In this solution, through a manner in which the source drivers 110 and the gate driver 120 share the bus 140 to receive the signals sent out by the timing controller 130 and the shared bus 140 performs signal transmission, pins of a source driver are saved and thus the encapsulation cost is reduced; and meanwhile, a space is saved for a layout of a PCB and a convenience is provided.

In one embodiment, a plurality of source drivers 110 are provided; the bus 140 includes:

data transmission lines 141, where the timing controller 130 respectively transmits a data signal to the gate driver 120 and the source drivers 110 via the data transmission lines 141; and a plurality of source driver selection signal lines 142, where the timing controller 130 is connected with the source drivers 110 via the source driver selection signal lines 142; the source driver selection signal lines 142 are connected with the source drivers 110 in one-to-one correspondence; and the source drivers 110 read the data signals from the data transmission lines 141 upon the reception of source driver selection signals of corresponding source driver selection signal lines 142.

In this solution, each source driver selection signal line 142 controls read-write of the signal of each source driver 110, so that only one source driver 110 receives the data signal on the bus 140 at a same time, and there is no phenomenon that the plurality of the source drivers 110 simultaneously receive the data signals on the bus 140 at the same time, i.e., there is no phenomenon that different source drivers 110 receive non-corresponding data signals. Therefore, the effect that the data signals are controlled to receive on the bus 140 via the source driver selection signals is implemented.

In one embodiment, two data transmission lines 141 are provided.

In this solution, the two data transmission lines 141 may perform data serial input and output, in which one data transmission line 141 inputs the data signal and the other data transmission line 141 outputs the data signal; and the two data transmission lines 141 are not affected to each other and operate simultaneously, so the efficiency is improved.

In one embodiment, the panel drive circuit 100 further includes a control circuit board 160 and a flexible circuit board 150; the timing controller 130 is located on the control circuit board 160; the source drivers 110 and the gate driver 120 are located on the flexible circuit board 150; a portion, connected with the timing controller 130, of the bus 140 is on the control circuit board 160; and branched points generated by that the bus 140 is respectively connected with the source drivers 110 and the gate driver 120 are on the flexible circuit board 150.

In this solution, since the bus 140 is only connected with the timing controller 130 on the control circuit board 160 and is respectively connected with the source drivers 110 and the gate driver 120 on the flexible circuit board 150, the wiring on the flexible circuit board 150 is convenient and the influence on an overall layout of a circuit board is small.

In one embodiment, the panel drive circuit 100 further includes a memory 170 configured to store data; and the memory 170 is connected with the timing controller 130.

In this solution, states that needs to be set for the source drivers 110 are stored in the memory 170. When the display apparatus is powered on, the timing controller 130 reads data in the memory 170 and writes the data to the source drivers 110, so that working states of the source drivers 110 are matched with those required by the panel. When it is necessary to adjust a drive manner, only the data stored in the memory 170 needs to be modified.

In one embodiment, referring to FIG. 1 to FIG. 3, the present application discloses a display apparatus, which includes a display panel 200, and a panel drive circuit 100 configured to drive the display panel 200 to display;

the panel drive circuit 100 includes a control circuit board 160, a flexible circuit board 150, a plurality of source drivers 110 located on the flexible circuit board 150, a gate driver 120 located on the control circuit board 160, a timing controller 130 and a memory 170;

the source drivers 110 are configured to drive a data line of the display panel 200; the gate driver 120 is configured to a scanning line of the display panel 200; the timing controller 130 is configured to drive the source drivers 110 and the gate driver 120; the memory 170 is configured to store data, and is connected with the timing controller 130;

the timing controller 130 reads data signals and source driver selection signals from the memory 170; a portion, connected with the timing controller 130, of the bus 140 is on the control circuit board 160; branched points generated by that the bus 140 is respectively connected with the source drivers 110 and the gate driver 120 are on the flexible circuit board 150;

the bus 140 includes: data transmission lines 141, where the timing controller 130 respectively transmits the data signals to the gate driver 120 and the source drivers 110 via the data transmission lines 141; and a plurality of source driver selection signal lines 142, where the timing controller 130 is connected with the source drivers 110 via the source driver selection signal lines 142;

the source driver selection signal lines 142 are connected with the source drivers 110 in one-to-one correspondence; and the source drivers 110 read the data signals from the data transmission lines 141 upon the reception of source driver selection signals of corresponding source driver selection signal lines 142.

In this solution, as illustrated in FIG. 2 and FIG. 3, three source drivers are included and three source driver selection signal lines are correspondingly provided; the source drivers 110 and the gate driver 120 share the bus 140 to receive signals sent out by the timing controller 130; each source driver selection signal line 142 controls read-write of the signal of each source driver 110, so that only one source driver 110 receives the data signal on the bus 140 in a same time, and there is no phenomenon that the plurality of the source drivers 110 simultaneously receive the data signals on the bus 140 at the same time, i.e., there is no phenomenon that different source drivers 110 receive non-corresponding data signals. The effect that the data signals are controlled to receive on the bus 140 via the source driver selection signals is implemented; and through the manner that the shared bus 140 performs signal transmission, pins of a source driver are saved and thus the encapsulation cost is reduced; and meanwhile, a space is saved for a layout of a PCB and a convenience is provided.

Figure 4:
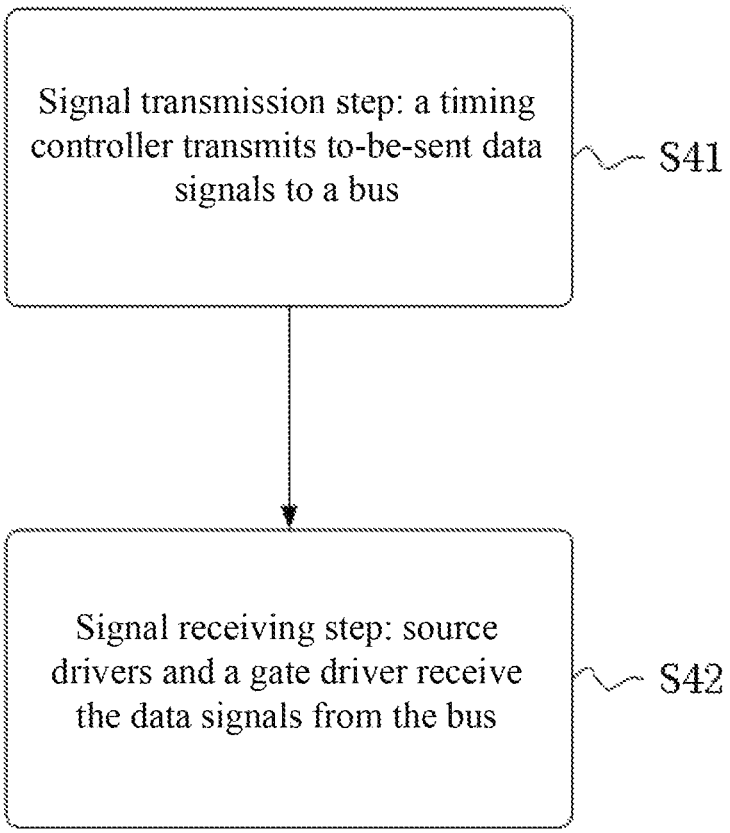
FIG. 4 is a schematic diagram of steps of a drive method in an embodiment of the present application.
Figure 5:
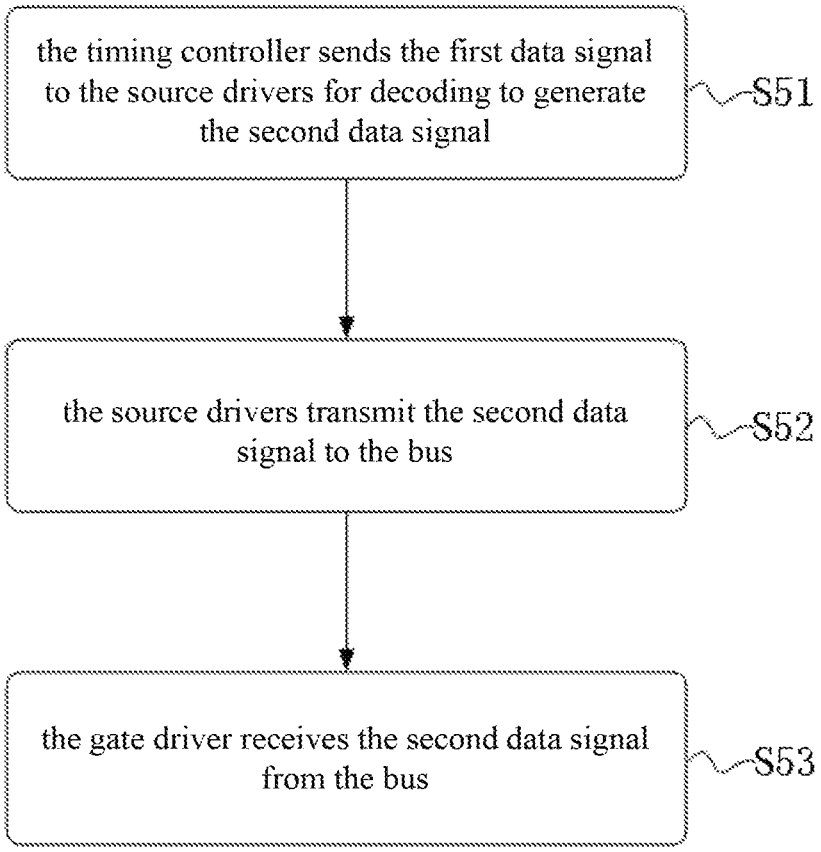
FIG. 5 is a schematic diagram of steps of a drive method in an embodiment of the present application.

In one embodiment, referring to FIG. 4 and FIG. 5, the present application discloses a drive method of a display apparatus, which includes the following steps.

S41: a signal transmission step: a timing controller 130 transmits data signals to a bus 140.

S42: a signal receiving step: source drivers 110 and a gate driver 120 receive the data signals from the bus 140.

In this solution, all data signals are transmitted to the source drivers 110 and the gate driver 120 via the bus 140. With only one bus 140, the timing controller 130, the gate driver 120 and the source drivers 110 can be connected together, so pins of a source driver are saved and thus the encapsulation cost of the source driver is saved.

In one embodiment, the bus 140 includes data transmission lines 141 and source driver selection signal lines 142;

the signal transmission step includes: the timing controller 130 transmits the data signals to the data transmission lines 141 and transmits source driver selection signals to the source driver selection signal lines 142; and the signal receiving step includes: the source drivers 110 and the gate driver 120 receives the data signals from the data transmission lines 141 according to the source driver selection signals.

In the signal receiving step, when a source driver selection signal on each source driver selection signal line 142 has a predetermined logic; the timing controller 130 performs signal transmission on source drivers 110 connected with one source driver selection signal line 142 via the data transmission lines 141, and only one source driver selection signal in all source driver selection signals at a same time has the predetermined logic.

In this solution, each source driver selection signal line 142 controls read-write of the signal of each source driver 110, so that only one source driver 110 receives the data signal on the bus 140 at the same time, and there is no phenomenon that the plurality of the source drivers 110 simultaneously receive the data signals on the bus 140 at the same time, i.e., there is no phenomenon that different source drivers 110 receive non-corresponding data signals. Therefore, the effect that, the data signals are controlled to receive on the bus 140 via the source driver selection signals is implemented.

In one embodiment, the timing controller 130 reads the data signals and the source driver selection signals from a memory 170 in the signal transmission step.

In this solution, states that needs to be set for the source drivers 110 are stored in the memory 170. When the display apparatus is powered on, the timing controller 130 reads data in the memory 170 and writes the data to the source drivers 110, so that working states of the source drivers 110 are matched with those required by the panel. When it is necessary to adjust a drive manner, only the data stored in the memory 170 needs to be modified.

In one embodiment, the data signals include a first data signal and a second data signal;

the signal transmission step includes: S51: the timing controller 130 sends the first data signal to the source drivers 110 for decoding to generate the second data signal; and S52: the source drivers 110 transmit the second data signal to the bus 140; and the signal receiving step includes: S53: the gate driver 120 receives the second data signal from the bus 140.

In this solution, the data signal sent to the gate driver 120 by the timing controller 130 may be decoded by the source drivers 110, and then is sent to the gate driver 120 by the source drivers 110. In this way, the time delay due to the fact that a plurality of gate drivers 120 and the source drivers 110 cannot share the data transmission lines 141 in a same time may be reduced.

It is to be noted that, the limit on each step related in this solution is not considered as a limit to a sequential order of the steps on the premise of not affecting implementation of a specific solution. A step written in front may be executed ahead and may also be executed later, or even may also be executed simultaneously; and as long as this solution can be implemented, all should be considered as a scope of protection of the present application.

In the present application, the panel may be a Twisted Nematic (TN) panel, an In-Plane Switching (IPS) panel, a Multi-domain Vertical Alignment (VA) panel, and of source, may also be other types of appropriate panels.

The above are further detailed descriptions of the present application in combination with specific optional implementation manners and should not be deemed as that the specific implementation of the present application is only limited to these descriptions. A person of ordinary skill in the art to which the present application belongs may further make a plurality of simple deviations or replacements without departing from the concept of the present application and all should be considered as the scope of protection of the present application.

What is claims is:

1. A display apparatus, comprising:

a display panel; and a panel drive circuit, configured to drive the display panel, wherein the panel drive circuit comprises:

at least one source driver, configured to drive a data line of the display panel;

at least one gate driver, configured to drive a scanning line of the display panel;

a timing controller, configured to control the source driver and the gate driver by driving; and a bus, configured to transmit signals;

the timing controller is directly coupled with the source driver via the bus, and is further directly coupled with the gate driver via the same bus; and the timing controller is configured to respectively transmit the signals to the source driver and the gate driver via the bus;

wherein a plurality of source drivers are provided;

the bus comprises:

data transmission lines, wherein the timing controller is configured to respectively transmit data signals to the gate driver and the source driver via the data transmission lines; and, a plurality of source driver selection signal lines, wherein the timing controller is connected with the source drivers via the respective source driver selection signal lines; the source driver selection signal lines are connected with the source drivers in one-tip-one correspondence; and each of the source drivers is configured to read the data signals from the data transmission lines upon the reception of a source driver selection signal from the respective source driver selection signal line;

wherein two data transmission lines are provided;

wherein the two data transmission lines are configured to perform data serial input and output respectively and independently, wherein data signals are input through one of the two data transmission lines, and output through the other of the two data transmission lines, where the two data transmission lines are capable of operating simultaneously;

wherein the data signals comprise a first data signal and a second data signal, wherein the timing controller is configured to send the first data signal to the source drivers through the one of the two data transmission lines used for data serial input for decoding to generate the second data signal and the source drivers are configured to transmit the second data signal to the other of the two data transmission lines of the bus used for data serial output, and the gate driver is configured to receive the second data signal from the bus.

2. The display apparatus according to claim 1, wherein the panel drive circuit further comprises a control circuit board and a flexible circuit board; the timing controller is disposed on the control circuit board; the source driver and the gate driver are disposed on the flexible circuit board; a portion, connected with the timing controller, of the bus is disposed on the control circuit board; and branched points generated by which the bus is respectively connected with the source driver and the gate driver are disposed on the flexible circuit board.

3. The display apparatus according to claim 1, wherein the panel drive circuit further comprises a memory configured to store data; and wherein the memory is connected with the timing controller.

4. A display apparatus, comprising:

a display panel; and a panel drive circuit, configured to drive the display panel to display, wherein the panel drive circuit comprises:

a control circuit board;

a flexible circuit board;

a plurality of source drivers, configured to drive data lines of the display panel, and disposed on the flexible circuit board;

at least one gate driver, configured to drive a scanning line of the display panel, and disposed on the flexible circuit board;

a timing controller, configured to control the source drivers and the gate driver by driving, and disposed on the control circuit board; and a memory, configured to store data; and connected with the timing controller, and disposed on the control circuit board; the timing controller is configured to read data signals and source driver selection signals from the memory disposed on the control circuit board;

a portion, connected with the timing controller, of a bus is on the control circuit board; branched points generated by which the bus is respectively connected with the source drivers and the gate driver are disposed on the flexible circuit board; the timing controller is configured to transmit signals to the source driver and the gate driver via the bus;

the bus comprises:

data transmission lines, wherein the timing controller is configured to respectively transmit the data signals to the gate driver and the source drivers via the data transmission lines, wherein the timing controller is directly coupled with the plurality of source drivers through the bus, and is further directly coupled to the gate driver through the same bus; and a plurality of source driver selection signal lines, wherein the timing controller is connected with the source drivers via the respective source driver selection signal lines; the source driver selection signal lines are connected with the source drivers in one-to-one correspondence; and each of the source drivers is configured to read the data signals from the data transmission lines upon the reception of a source driver selection signal from the respective source driver selection signal line;

wherein two data transmission lines are provided;

wherein the two data transmission lines are configured to perform data serial input and output respectively and independently, wherein data signals are input through one of the two data transmission lines, and output through the other of the two data transmission lines, where the two data transmission lines are capable of operating simultaneously;

wherein the data signals comprise a first data signal and a second data signal, wherein the timing controller is configured to send the first data signal to the source drivers through the one of the two data transmission lines used for data serial input for decoding to generate the second data signal, and the source drivers are configured to transmit the second data signal to the other of the two data transmission lines of the bus used for data serial output, and the gate driver is configured to receive the second data signal from the bus.

5. A drive method of a display apparatus, the display apparatus comprising:

a display panel; and a panel drive circuit, configured to drive the display panel, wherein the panel drive circuit comprises:

at least one source driver, configured to drive a data line of the display panel;

at least one gate driver, configured to drive a scanning line of the display panel;

a timing controller, configured to control the source driver and the gate driver by driving; and a bus, configured to transmit signals;

the timing controller is directly coupled with the source driver via the bus, and is further directly coupled with the gate driver via the same bus;

wherein the timing controller is configured to respectively transmit the signals to the source driver and the gate driver via the bus;

wherein a plurality of source drivers are provided:

the bus comprises:

data transmission lines, wherein the timing controller is configured to respectively transmit data signals to the gate driver and the source driver via the data transmission lines; and a plurality of source driver selection signal lines, wherein the timing controller is connected with the source drivers via the respective source driver selection signal lines: the source driver selection signal lines are connected with the source drivers in one-to-one correspondence; and each of the source drivers is configured to read the data signals from the data transmission lines upon the reception of a source driver selection signal from the respective source driver selection signal line;

wherein two data transmission lines are provided;

wherein the two data transmission lines are configured to perform data serial input and output respectively and independently, wherein data signals are input through one of the two data transmission lines, and output through the other of the two data transmission lines, where the two data transmission lines are capable of operating simultaneously;

wherein the data signals comprise a first data signal and a second data signal, wherein the timing controller is configured to send the first data signal to the source drivers through the one of the two data transmission lines used for data serial input for decoding to generate the second data signal, and the source drivers are configured to transmit the second data signal to the other of the two data transmission lines of the bus used for data serial output, and the gate driver is configured to receive the second data signal from the bus:

wherein the drive method comprises:

a signal transmission step: transmitting, by the timing controller, the data signals to the bus; and a signal receiving step: receiving, by the source drivers and the gate driver, the data signals from the bus;

wherein the signal transmission step comprises: sending, by the timing controller, the first data signal to the source drivers through the one of the two data transmission lines used for data serial input for decoding to generate the second data signal; and transmitting, by the source drivers, the second data signal to the other of the two data transmission lines of the bus used for data serial output; and the signal receiving step comprises: receiving, by the gate driver the second data signal from the bus.

6. The drive method according to claim 5, wherein the first data signal comprises a source drive signal and a gate drive signal; and the source drivers decode to obtain the gate drive signal and send the decoded gate drive signal to the bus.

7. The drive method according to claim 5, wherein the panel drive circuit further comprises a control circuit board and a flexible circuit board; the timing controller is disposed on the control circuit board; the source driver and the gate driver are disposed on the flexible circuit board; a portion, connected with the timing controller, of the bus is disposed on the control circuit board; and branched points generated by which the bus is respectively connected with the source driver and the gate driver are disposed on the flexible circuit board.

8. The drive method according to claim 5, wherein the panel drive circuit further comprises a memory configured to store data; and wherein the memory is connected with the timing controller.

9. The drive method according to claim 5, wherein the bus comprises the data transmission lines and the source driver selection signal lines;

the signal transmission step comprises: transmitting, by the timing controller, the data signals to the data transmission lines, and transmitting the source driver selection signals to the source driver selection signal lines; and the signal receiving step comprises: receiving, by the source drivers and the gate driver, the data signals from the data transmission lines depending on the source driver selection signals.

10. The drive method according to claim 9, wherein the timing controller reads the data signals and the source driver selection signals from a memory in the signal transmission step.

* * * * *